US005386916A

United States Patent [19]

Valiulis

[11] Patent Number: 5,386,916

[45] Date of Patent: Feb. 7, 1995

[54] ADJUSTABLE STRIP MERCHANDISER

[75] Inventor: Stanley C. Valiulis, Rockford, Ill.

[73] Assignee: Southern Imperial, Inc., Rockford, Ill.

[21] Appl. No.: 111,206

[22] Filed: Aug. 24, 1993

[51] Int. Cl.[6] ..... A47F 5/00

[52] U.S. Cl. ..... 211/113; 211/73

[58] Field of Search ..... 211/113, 118, 117, 71, 211/73; 248/909, 220.4, 221.3, 339

[56] References Cited

U.S. PATENT DOCUMENTS

| | | | |
|---|---|---|---|
| 887,272 | 5/1908 | Robinson | 248/909 X |
| 4,149,692 | 4/1979 | Califano | 248/909 X |
| 4,318,528 | 3/1982 | Dobson | 248/909 X |
| 4,483,502 | 11/1984 | Fast | 248/222.1 |
| 4,497,464 | 2/1985 | Fast | 211/113 X |
| 4,546,943 | 10/1985 | Fast | 258/205.3 |
| 4,718,627 | 1/1988 | Fast et al. | 211/113 X |
| 4,911,392 | 3/1990 | Fast | 211/113 X |
| 5,040,316 | 8/1991 | Fast | 248/909 X |
| 5,096,070 | 3/1992 | Jaynes | 211/113 X |

*Primary Examiner*—Karen J. Chotkowski

*Attorney, Agent, or Firm*—Leydig, Voit & Mayer, Ltd.

[57] ABSTRACT

A strip merchandiser, used for displaying merchandise, includes an elongated plastic strip having a hole in its upper end portion for suspending the strip from a hanger and having a plurality of sections divided by transversely extending score lines. A pair of holes located in proximity to and spaced equal distances from opposite sides of each score line allows the merchandiser to be re-suspended from the hanger after a section has been folded behind or separated from the remaining strip.

8 Claims, 1 Drawing Sheet

ADJUSTABLE STRIP MERCHANDISER

BACKGROUND OF THE INVENTION

This invention relates to a strip merchandising device and, more particularly, to a device of the same general type as disclosed in Fast U.S. Pat. No. 4,546,943. That device includes an elongated plastic strip adapted to be suspended from a hanger and adapted to support vertically overlapping items of merchandise.

In the strip merchandiser of the Fast patent, the elongated plastic strip is formed with a series of vertically spaced holders for supporting the merchandise. When an item of merchandise is removed from the strip, the corresponding holder remains empty. An accumulation of empty holders results in an unappealing merchandise display. Because the merchandisers are typically shipped to the merchant with merchandise pre-attached to the holders, the merchandisers cannot be removed from a display until they are entirely empty.

SUMMARY OF THE INVENTION

The general aim of the present invention is to provide a new and improved strip merchandiser capable of being suspended from a display hanger and adapted to be modified by the merchant so that the visible portion of the merchandiser remains substantially full of product.

A more detailed object of the invention is to achieve the foregoing by providing a strip merchandiser in which adjacent sections of the strip are separated by a weakened line such as a score line, thereby allowing an empty section of the strip to be either folded behind or torn away from the remaining full sections of the strip.

A further object of the invention is to provide a strip merchandiser having equally spaced holes located above and below each score line so that, when the strip is either folded or torn away at a score line, the remaining sections of the merchandiser can be re-suspended from the display hook.

These and other objects and advantages of the invention will become more apparent from the following detailed description when taken in conjunction with the accompanying drawings.

DETAILED DESCRIPTION OF THE PREFERRED EMBODIMENT

Figures 1, 2, 3, 4:
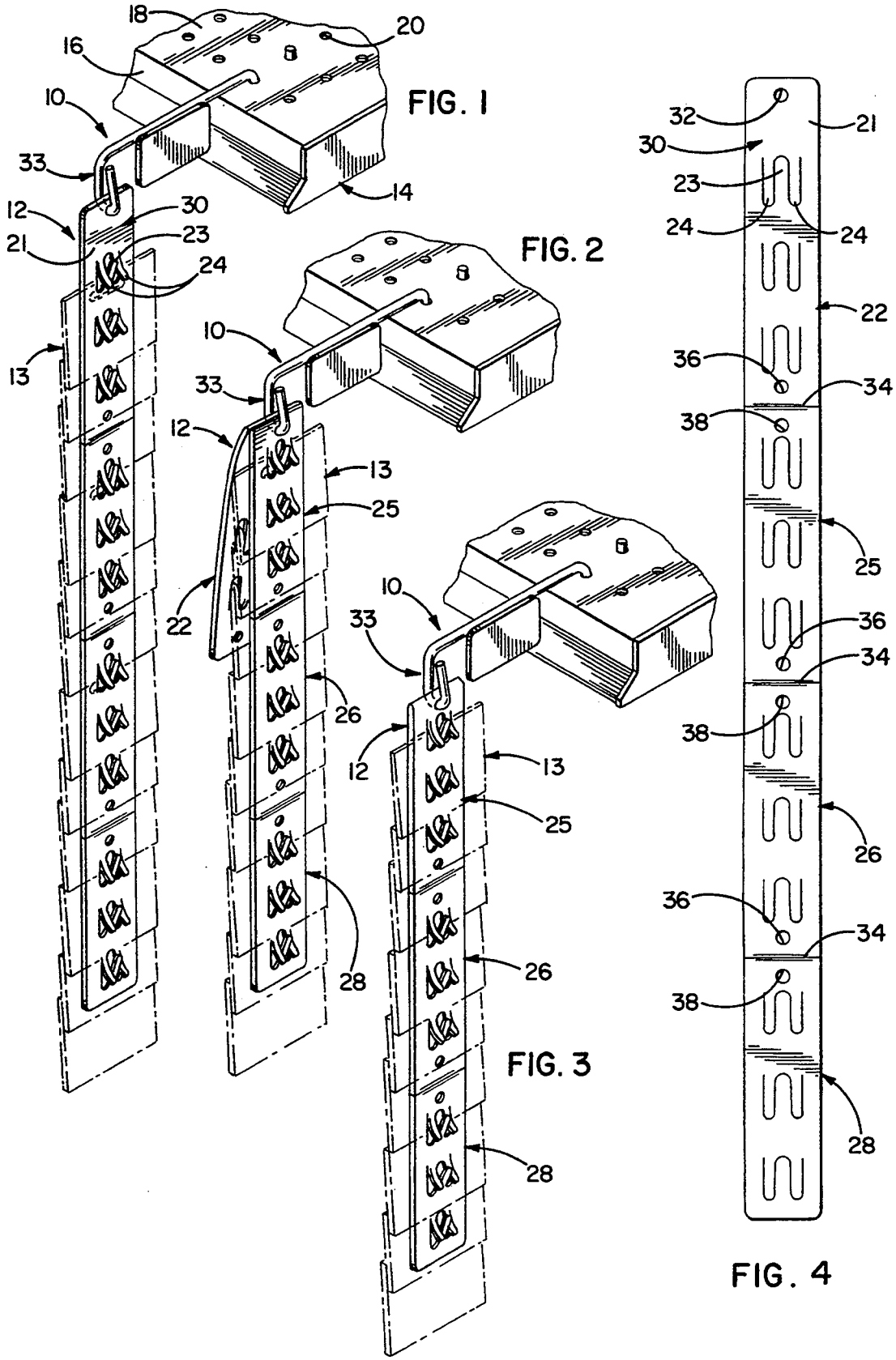
FIG. 1 is a fragmentary perspective view of a typical shelf and display hanger equipped with a new and improved strip merchandiser incorporating the unique features of the present invention.
FIG. 2 is a view similar to FIG. 1 but shows an empty top section of the strip merchandiser folded behind the remaining full sections.
FIG. 3 also is a view similar to FIG. 1 except the empty top section of the strip merchandiser has been torn away from the remaining full sections.
FIG. 4 is an enlarged front view of the strip merchandiser.

For purposes of illustration, the invention has been shown in the drawings as embodied in a strip merchandiser 12 which is particularly suited for displaying merchandise 13 from a display hanger 10 in front of a horizontal shelf 14 having a front edge 16 and having a horizontal surface 18 which is formed with several rows of transversely spaced and vertically extending holes 20.

The merchandiser 12 is formed from an initially flat and planar single-piece plastic strip 21 which may be stamped from sheet stock. The strip includes item-supporting portions 22, 25, 26 and 28 each formed with a series of vertically spaced and elongated W-shaped slits each defining a central upwardly extending product suspension hook 23 and a pair of outer stabilizing fingers 24. The upper end portion 30 of the strip is formed with a hole 32 to allow the strip to be suspended from a hook 33 of the display hanger 10.

In accordance with the present invention, transversely extending weakened lines such as score lines 34 divide the item supporting portions 22, 25, 26 and 28 of the strip 21 into distinct sections, namely, a top section, two intermediate sections and a bottom section, respectively. Suspending holes 36 and 38 are spaced an equal distance above and below each score line. Because merchandise 13 disposed on the strip 21 sometimes overlaps, the merchandise is typically removed from the top of the strip first. As will become apparent subsequently, the score lines 34 and suspending holes 36, 38 allow the empty upper sections of the strip to be either folded behind or separated from the remaining full sections.

More specifically, each section 22, 25, 26 and 28 contains three sets of product suspension hooks 23 and corresponding outer stabilizing fingers 24. Adjacent sections are separated from each other by one of the score lines 34. Each score line extends transversely across the strip 21 perpendicular to the elongated edges of the strip. Each score line 34 is defined by a groove with a thickness less than the thickness of the strip and stamped so as to allow the strip to be easily folded or separated at the score line. The thickness of each score line is sufficient to insure that the tensile strength of the strip is adequate to suspend the merchandise 13.

As pointed out above, the holes 36 and 38 of each pair are spaced equidistantly from and are located on opposite sides of a score line 34. Accordingly, when the top section 22 is empty, it may be removed from the hanger 10 and folded downwardly behind the first intermediate section 25. When the top section 22 is so folded, its hole 36 becomes aligned with the hole 38 of the intermediate section 25. As a result, the strip 21 may be rehung on the hanger 10 by slipping the aligned holes 36, 38 over the hook 33 as shown in FIG. 2 so that a full section is adjacent the hanger while the empty section is hidden behind the remainder of the strip. As the intermediate sections 25 and 26 become successively empty, they may be folded downwardly similar to the top section and the strip may be successively rehung.

As an alternative to folding the sections 22, 25 and 26, the sections may simply be successively torn away from the remainder of the strip 21 along the score lines 34. For example, when the top section 22 is empty, it may be torn away along the uppermost score line and then the strip may be rehung by using the hole 38 in the first intermediate section 25.

From the foregoing, it will be apparent that the present invention brings to the art a new and improved strip merchandiser 12 having laterally extending score lines which divide the merchandiser into distinct sections, thereby allowing a section depleted of merchandise to be removed from sight. By virtue of providing a hole through the strip on one side of each score line and providing a corresponding hole an equal distance on the opposite side of each score line, the merchandiser can be folded and re-displayed with empty sections removed from sight. Alternatively, sections may simply be torn away from the strip as the sections become empty.

I claim:

1. A strip merchandiser for supporting merchandise items, said merchandiser comprising an integrally formed elongated and upright plastic strip having vertically spaced integral means for supporting said items, said strip having a plurality of vertically spaced and transversely extending weakened lines extending substantially across the entire width of the strip, said lines dividing said strip into a top section, at least one intermediate section, and a bottom section, the upper end portion of said top section having a first hole to permit said strip to be suspended from a hanger inserted through said hole, and an additional hole formed through said strip below each of said lines for optionally receiving said hanger, said plastic strip being sufficiently flexible along each of said lines to permit any section of said strip to be folded into face-to-face relation with an adjacent section along the line between such sections.

2. A strip merchandiser as defined in claim 1 in which still another hole is formed through said strip above each of said lines and is spaced an equal distance from such line as the most nearly adjacent additional hole.

3. A strip merchandiser as defined in claim 1 in which each of said weakened lines is a score line defined at least in part by a groove in said strip.

4. A strip merchandiser for supporting merchandise items, said merchandiser comprising an integrally formed elongated and upright plastic strip having vertically spaced integral means for supporting said items, said strip having a plurality of vertically spaced and transversely extending score lines extending across substantially the entire width of the strip, said score lines subdividing said strip into a top section, at least one intermediate section, and a bottom section, the upper end portion of said top section having a first hole to permit said strip to be suspended from a hanger inserted through said hole, an additional hole formed through said strip below each of said score lines for optionally receiving said hanger, there being still another hole formed through said strip above each of said score lines and spaced an equal distance from such score line as the most nearly adjacent additional hole.

5. A strip merchandiser for supporting merchandise items, said merchandiser comprising an elongated plastic strip having integral hanger means spaced along the length of the strip for supporting said items, said strip having a plurality of transversely extending weakened lines extending substantially across the entire width of the strip and spaced from one another along the length of the strip, said lines dividing said strip into a first end section, at least one intermediate section, and a second end section, each of said sections having a plurality of said hanger means spaced along the length of such section, one end portion of each section having a hole to permit said strip to be suspended from a hanger inserted through said hole, said lines being weaker than the remainder of said strip and permitting adjacent sections to be torn away from one another, said plastic strip being sufficiently flexible along each of said lines to permit any section of said strip to be folded into face-to-face relation with an adjacent section along the line between such sections.

6. A strip merchandiser for supporting merchandise items, said merchandiser comprising an elongated plastic strip having a longitudinal centerline, said strip having integral hanger means spaced along the length of the strip for supporting said items, said hanger means being centered on said centerline, said strip having a plurality of transversely extending weakened lines extending substantially across the entire width of the strip and spaced from one another along the length of the strip, said lines dividing said strip into a first end section, at least one intermediate section, and a second end section, each of said sections having a plurality of said hanger means spaced along the length of such section, one end portion of each section having a hole to permit said strip to be suspended from a hanger received through said hole, said holes also being centered on said centerline, and said lines being weaker than the remainder of said strip and permitting adjacent sections to be torn away from one another, said plastic strip being sufficiently flexible along each of said lines to permit any section of said strip to be folded into face-to-face relation with an adjacent section along the line between such sections.

7. A strip merchandiser as defined in claim 6 in which said holes which are centered on said centerline are the only hanger-receiving holes of said strip.

8. A strip merchandiser as defined in claim 6 in combination with a hanger which permits said strip to be slipped onto and off of said hanger by way of one of said holes when said hanger is in a fixed position.

* * * * *